United States Patent [19]

Blampain et al.

[11] 4,348,138

[45] Sep. 7, 1982

[54] SLIDING SUPPORTING GALLERY

[75] Inventors: Guy Blampain, Verneuil.en.Halatte; Pierre Grandfils, Precy-sur-Oise, both of France

[73] Assignee: Charbonnages de France, Paris, France

[21] Appl. No.: 163,474

[22] Filed: Jun. 27, 1980

[30] Foreign Application Priority Data

Jul. 6, 1979 [FR] France ..... 79 17587

[51] Int. Cl.[3] ..... E21D 23/00

[52] U.S. Cl. ..... 405/297; 405/298

[58] Field of Search ..... 405/291, 297, 298, 299, 405/300; 299/31, 33

[56] References Cited

U.S. PATENT DOCUMENTS

| | | | |
|---|---|---|---|
| 3,367,117 | 2/1968 | Weirich et al. | 405/300 X |
| 4,109,473 | 8/1978 | Valantin . | |
| 4,114,385 | 9/1978 | Valantin | 405/298 |
| 4,129,990 | 12/1978 | Valantin . | |

FOREIGN PATENT DOCUMENTS

| | | | |
|---|---|---|---|
| 1092412 | 11/1960 | Fed. Rep. of Germany | 405/298 |
| 1139084 | 11/1962 | Fed. Rep. of Germany . | |
| 2729564 | 12/1978 | Fed. Rep. of Germany . | |
| 2339057 | 8/1977 | France . | |
| 2356809 | 1/1978 | France . | |

*Primary Examiner*—David H. Corbin

*Attorney, Agent, or Firm*—Cushman, Darby & Cushman

[57] ABSTRACT

A gantry support for supporting a roof of a passage is advanceable along a floor of the passage. The support has two parallel supporting elements mutually spaced apart laterally of the support, each element including at least two pairs of frames provided with articulated tracks. One frame of each pair is an upper frame and the other is a lower frame, the tracks of which are adapted to be applied respectively against the roof and floor of the passage by loading jacks applying a spreading force between the upper and lower frames. An intermediate upper frame is carried by an upper cross-member extending from one supporting element to the other and at least one loading jack applying a spreading force connects each lower frame to the corresponding end of the upper cross-member.

10 Claims, 3 Drawing Figures

SLIDING SUPPORTING GALLERY

BACKGROUND OF THE INVENTION

The present invention relates to a gantry roof support for supporting the roof of a passage.

Various types of roof supports are known which comprise articulated track carrying frames which are mutually spaced apart and arranged to clamp the tracks against the roof and floor of mine workings or the like. Such supports are either self propelled or are hauled or pushed by anchoring means.

A support of this kind is described in particular in French Patent Application No. 76 01961 (publication No. 2 339 057).

Another support is described in U.K. Patent Specification No. 1,571,444, equivalent to French Patent Application No. 76 19718 (publication No. 2 356 809).

Such supports must be installed relatively close to one another in order to withstand the ground pressures to which they are subjected. Consequently they do not permit the easy circulation of equipment, and still less easily the passage of machines.

An object of the present invention is to provide a support which can be used in particular in headings and which permits the passage of machines by leaving clear a large surface on the floor, that is to say the "wall" in mining parlance. This object must be achieved as well as good support for the roof, in order to protect personnel and equipment against accidents caused by roof falls. These objects however, cannot be achieved by means of a rigid shield on the roof, because the irregularities of the roof would give rise to poor distribution of the load. It is therefore necessary to have a support offering at the same time a large passage width and good flexibility of adaptation to irregularities of the roof.

SUMMARY OF THE PRESENT INVENTION

According to the present invention there is provided a gantry roof support for supporting a roof of a passage and advanceable along a floor of such passage, the support comprising:

(a) two pairs of frames spaced from each other laterally of the support and each including an upper frame provided with an articulated track and a lower frame provided with an articulated track;

(b) an upper cross-member extending between the upper frames and having opposite ends connected to the upper frames;

(c) an intermediate frame carried by the upper-cross member and located between the upper frames; and (d) jack means associated with each pair of frames and operable to apply a force to the upper and lower frames and the upper-cross member to cause the tracks of the upper and lower frames to be applied respectively against the roof and the floor of the passage.

Three upper frames, or more if desired, can be permanently applied against the roof, each of them being able to be applied with an inclination matching the mean inclination of the roof which it supports. Also the desired passage opening is obtained between the two lower frames which are spaced apart laterally of the support.

In a preferred embodiment the support is provided with means of mutual transmission of longitudinal thrust between the intermediate upper frame and each of the lateral upper frames.

It is advantageous for the means of mutual transmission of longitudinal thrust to be arms each mounted for pivotation about a respective pin extending longitudinally of the support and carried by one of the cross-member and a lateral upper frame, the arms each having a free end articulated to the respective other of said upper cross-member and said lateral upper frame.

In this way the best possible flexibility is obtained for matching the irregularities of the roof, while supporting it with good distribution of the load and effecting good driving of the intermediate upper frame without play and without jolting.

Still better thrust driving of the intermediate upper frame is achieved if each lower frame and the associated end of the upper cross-member are joined together by a connecting arm which is oblique and is arranged to rise in the direction of advance of the support. This serves as an intermediate means of transmission of the loading by the associated jack between the associated lower frame and the associated end of the upper cross-member.

Preferably the support is provided with separate drive mechanisms for each lower frame.

Also the intermediate upper frame preferably comprises an articulated track.

The intermediate upper frame may extend forwards of the support beyond the lateral upper frames and beyond the front of the lower frames. In this way front protection of the support is obtained.

In order to facilitate the adjustment of slack of the articulated tracks of the upper frames and to adapt these upper frames to the irregularities of the roof, preferably at least one of the upper frames is provided at its forward end with a portion articulated about a transverse horizontal axis and is provided with means of adjusting the inclination of this articulated portion.

Connections between the jacks and frames, and between the connecting arms and the frames, may be made with the aid of stirrups.

BRIEF DESCRIPTION OF THE DRAWINGS

An embodiment of the present invention will now be described, by way of example with reference to the accompanying drawings in which.

DESCRIPTION OF THE PREFERRED EMBODIMENT

Figure 2:
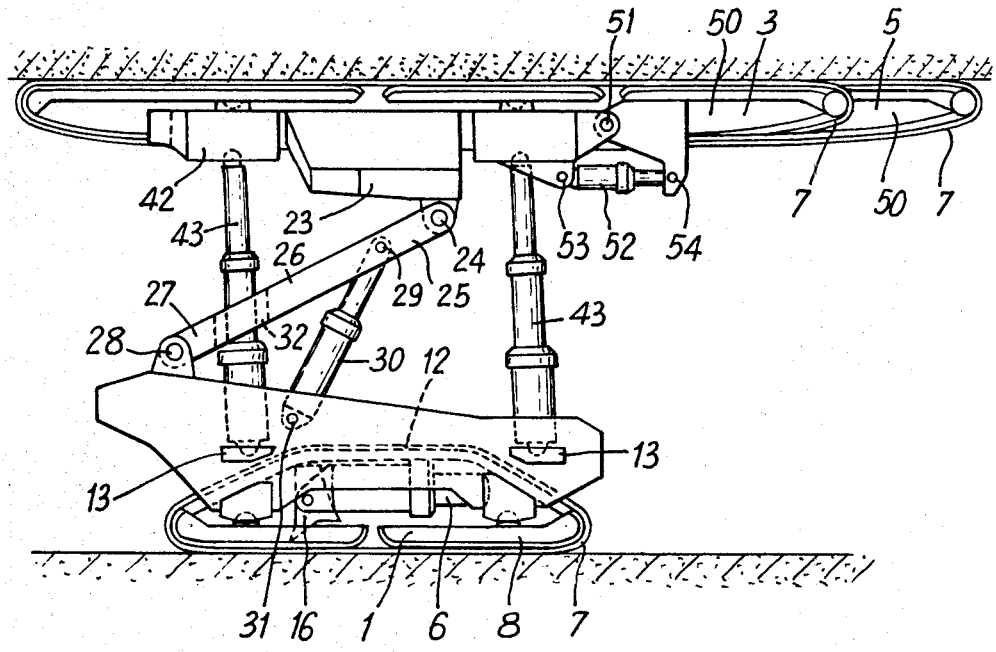
FIG. 2 is a side view of the complete support shown in FIG. 1.

A support embodying the present invention comprises two lower frames 1 and 2 and three upper frames 3, 4, 5, all of which are parallel.

The two lower frames 1 and 2 illustrated generally at 6 are fitted with an articulated track 7 and have a portion 8 which is enclosed by the track 7 and provided with cross-members 9 on which are fixed an outer side plate 10 and an inner side plate 11. These side plates are joined together, above the upper return run 12 of the track 7, by two cross-members 13. The assembly comprising the two side plates 10 and 11 and the cross-members 13 constitutes a stirrup 14 of the type described in French Patent No. 2 339 057.

As has already been stated, the support has three upper frames, namely two lateral frames 3 and 4 and a central frame 5. The lower frame 1, together with the upper frame 3, which is vertically above the frame 1, form a pair of articulated track frames constituting a first support element. Similarly, the upper frame 4 and the lower frame 2 form a second pair of articulated track frames constituting a second support element.

The intermediate upper frame 5 is carried by a rigid cross-member 20, which is extended integrally in the forward and rearward directions to form a cross, by a longitudinal member 21 which, together with the cross-member 20, forms a frame member 22 of the upper frame 5, having an articulated track 7. Each lateral end 23 of the cross-member 20 is offset downwards and carries two aligned bearings 24 for transverse articulation of the upper end 25 of a connecting arm 26, whose lower end 27 is articulated on two aligned bearings 28 carried at the upper rear end of each of the plates 10, 11, the axes of these bearings being parallel to that of the bearings 24.

Substantially at three-quarters of their height the connecting rods 26 carry a pivot pin 29 parallel to the aforesaid axes, for the top end of a jack 30 whose bottom end is pivoted on a pin 31 which, above the return run 12 of the track 7, joins together the two plates 10 and 11 parallel to the cross-members 13. The connecting arms 26 are generally planar and are provided with a hole 32 for the passage of props, which will be discussed below.

By means of a spreading thrust, jacks 30 can apply a clamping action to the cross-member 20 which carries the upper frame 5 and which rises obliquely in the forward direction, thus providing good clamping against the roof when the towed or self-propelled lower frames advance the support.

The frame members 41 of the upper frames 3 and 4 are carried by stirrups 42, each of which is supported by articulation by means of a vertical prop 43, having a lower end pivotally mounted on one of the cross-members 13 suitably disposed for that purpose. Passage holes 32 in the connecting rods 25 serve to permit the passage of the rear props 43 in all positions.

The fastening stirrups 42 for the frame members 41 of the upper frames 3, 4 are each carried by an arm 44 extending substantially horizontal and parallel to the general direction of the cross-member 20, and they are connected by pivot joints 45 which are parallel to the longitudinal member 21, which is integral with the cross-member 20. The arms 44 abut longitudinally against the pins of the pivot joints 45, so that mutual transmission is achieved of longitudinal thrust between the central upper frame 5 and the lateral upper frames 3 and 4.

Each supporting element is provided with autonomous means for the displacement of the lower frames 1 or 2, such means being for example of the type described in French Pat. No. 2 339 057, and comprising a ratchet device 16 acting directly on the skids 15 of its track 7, this ratchet device 16 being adapted to be operated by thrust or by retraction by means of a jack 17 mounted in lower frame 1 or 2.

Figure 1:
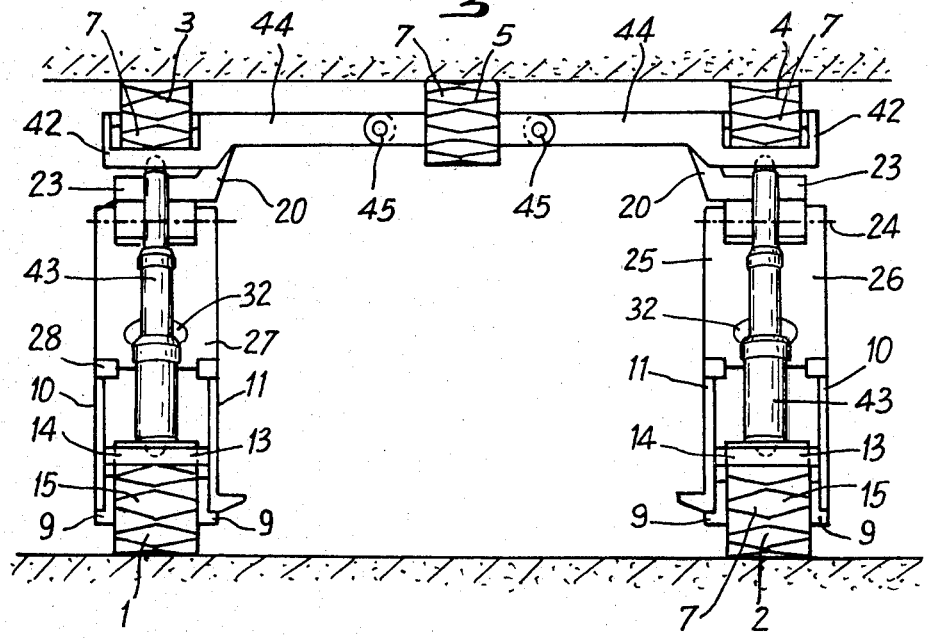
FIG. 1 is a diagrammatical front view of a support embodying the present invention, in which thrust jacks of the cross-member are omitted for the sake of clarity of the drawing.
Figure 3:
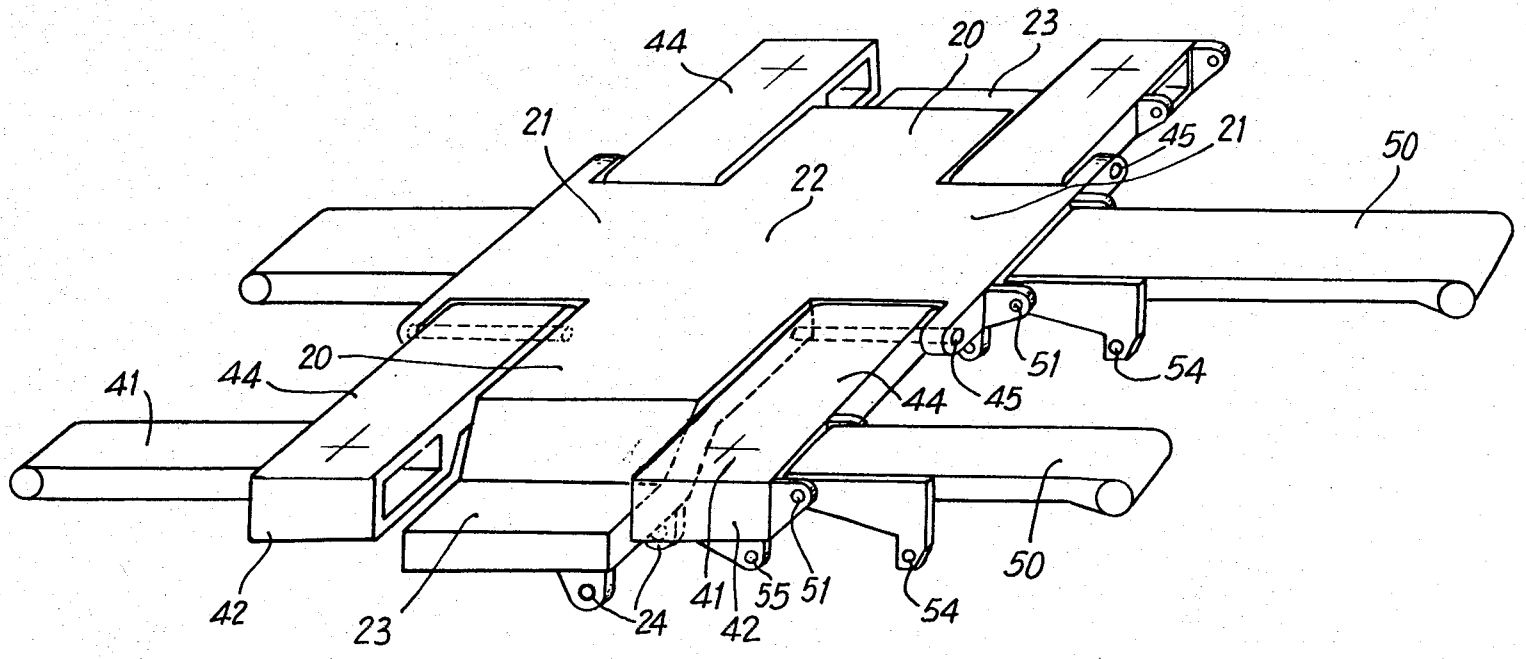
FIG. 3 is a diagrammatical view in perspective of the upper cross-member of the support shown in FIGS. 1 and 2, illustrating pivotable arms and part of the upper frames but with the jacks and the tracks omitted, in order to facilitate the understanding of the complete structure.

As can be seen in FIG. 1, the three upper frames 3, 4 and 5 extend at least beyond the front of the lower frames 1 and 2, but the upper frame 5 extends further forward than the other two upper frames 3 and 4.

In order to facilitate passage in the event of irregularities in the roof, and in order to tighten the track as well as possible, the frame member 41 of each upper frame 3, 4, and also the frame member 22 of the upper frame 5, are provided with a front portion 50 articulated about a transverse horizontal axis 51 and adapted to be angularly adjusted by means of a jack 52 bearing on the one hand on an articulation 53 of the central portion of the frame member 41 or 21, which articulation 53 is spaced apart from the axis 51, and on the other hand on an articulation 54 of the front portion 50, this articulation 54 likewise being spaced apart from the axis 51.

It has been stated above that the cross-member 20 has its ends offset downwards. This downward offsetting is dictated by the free space that must be left respectively between each of the two ends of this cross-member and each of the corresponding upper frames 3 and 4.

We claim:

1. A roof support for use in mines between a roof and a floor comprising two pairs of frames spaced from each other laterally of the support and each including an upper frame provided with an articulated track and a lower frame provided with an articulated track, wherein the frames are spaced apart by a large passage for use as heading, an upper cross-member extending between said upper frames, the opposite ends of said upper cross-member being connected to said upper frames, an intermediate upper frame having an articulated track being carried by said upper cross-member and located between said upper frames, jack means associated with each pair of frames and operable to apply a force between the lower frames and the upper cross-member to cause the track of the intermediate upper frame to be applied against the roof of the passage.

2. A support according to claim 1, comprising means for transmission of thrust longitudinally of the support, between the intermediate frame and each of the lateral upper frames.

3. A support according to claim 2, wherein the means for the transmission of such thrust comprises arms each mounted for pivoting about a respective pin extending longitudinally of the support and carried by one of the cross-member and the associated lateral upper frame, the arms each having an end articulated to the respective other of said upper cross-member and said lateral upper frame.

4. A support according to claim 1, comprising a connecting arm connecting each lower frame to an associated end of the upper cross-member.

5. A support according to claim 4, wherein the jacks between the lower frames and associated ends of the upper cross-member are arranged to act through the connecting arm.

6. A support according to claim 4, wherein the connecting arm is oblique and is arranged to rise in the direction of advance of the support.

7. A support according to claim 1, comprising a respective driving mechanism for each lower frame.

8. A support according to claim 1, wherein the intermediate frame extends forwards of the support beyond the lateral upper frames and extends beyond the lower frame.

9. A support according to claim 1, wherein at least one of the upper frames is provided with a forward portion articulated about a transverse horizontal axis and is provided with means for adjusting the inclination of the articulated portion.

10. A support according to claim 4, comprising stirrups for connecting the frames to the jacks and to the connecting arms.

* * * * *

UNITED STATES PATENT AND TRADEMARK OFFICE

CERTIFICATE OF CORRECTION

PATENT NO. : 4,348,138

DATED : September 7, 1982

INVENTOR(S) : Guy BLANPAIN & Pierre GRANDFILS

It is certified that error appears in the above—identified patent and that said Letters Patent is hereby corrected as shown below:

On the title page re Inventors [Item 75]

First Inventor "Guy Blampain" should read

--Guy BLANPAIN--

Signed and Sealed this

*Twenty-sixth* Day of *April 1983*

[SEAL]

*Attest:*

GERALD J. MOSSINGHOFF

*Attesting Officer*

*Commissioner of Patents and Trademarks*